US005420767A

United States Patent [19]

Jones

[11] Patent Number: 5,420,767

[45] Date of Patent: May 30, 1995

[54] DUAL-LIGHTED CLAMP

[76] Inventor: Robert N. Jones, 1613 Kame Ave., Simi Valley, Calif. 93065

[21] Appl. No.: 166,560

[22] Filed: Dec. 14, 1993

[51] Int. Cl.[6] ..... F21V 33/00

[52] U.S. Cl. ..... 362/109; 362/157; 362/249; 362/253; 362/396

[58] Field of Search ..... 362/109, 119, 120, 253, 362/396, 249, 157, 190, 191

[56] References Cited

U.S. PATENT DOCUMENTS

| | | | |
|---|---|---|---|
| 895,355 | 8/1908 | Farr | 362/109 |
| 1,684,347 | 9/1928 | Dobbs . | |
| 2,034,913 | 3/1936 | Kros . | |
| 2,376,448 | 5/1945 | Neugass | 362/120 |
| 2,448,582 | 9/1948 | Fike | 362/396 |
| 2,666,843 | 1/1954 | Zuckerman | 362/120 |
| 2,854,564 | 9/1958 | Cohen et al. | 362/119 |
| 2,966,580 | 12/1960 | Taylor . | |
| 4,417,299 | 11/1983 | Rupp . | |
| 4,433,364 | 2/1984 | Noble | 362/109 |
| 5,209,562 | 5/1993 | Glassford | 362/396 |

*Primary Examiner*—Richard R. Cole
*Attorney, Agent, or Firm*—Poms, Smith, Lande & Rose

[57] ABSTRACT

A portable, lightweight, dual-lighted clamp having two jaws for gripping a variety of objects and a pair of battery-operated flashlights assemblies integrally built into the handles, with the light bulbs and transparent illuminating areas located at each of the jaws. The spring clamp may be conveniently attached to many hard-to-reach places. The flashlights each have a switch actuator for allowing the user to easily operate each flashlight.

20 Claims, 2 Drawing Sheets

11
13
15
17
19
21
25
26
27
29
31
33
35
37
50
51
52
54
56
70
75
4
4

DUAL-LIGHTED CLAMP

FIELD OF THE INVENTION

The present invention relates to illuminated clamp apparatuses and more particularly to a novel dual-lighted clamp which is portable, lightweight, battery-operated and easy to use.

BACKGROUND OF THE INVENTION

Traditionally, repairmen and tradesmen have used electric lamps or portable handheld flashlights to illuminate dark or poorly lit work places to make repairs or perform various other types of work such as construction or automotive work. For example, plumbers are often required to enter crawl spaces to either connect new pipes or repair defective pipes. These crawl spaces are usually extremely dark. In order to easily view these pipes, plumbers will either use a handheld flashlight or an electric lamp requiring an independent source of electricity, i.e., an electrical outlet, to illuminate their places of work.

For many repairmen and tradesmen the use of a handheld flashlight often requires the assistance of a helper to hold the light and properly aim it on the given place of work. Thus, the trade skills of the helper may be rendered useless so long as he is required to hold and aim the flashlight. Other times, the repairman would lay the flashlight down on another object while aiming the beam of light on the area where he or she is performing his or her job. In this situation, the flashlight may often roll out of place causing the repairman to constantly re-aim the beam of light. Moreover, there may not even be an object available in which the flashlight may be properly set down upon.

On the other hand, many tradesmen often use an electrical lamp that includes a clamp attachment. Even though these lamps enable one to freely use both hands while having a source of light aimed at their place of repair, these lamps require an independent source of electricity which may not always be available. In addition these lamps are quite bulky and are difficult to attach in hard-to-reach places. These lamps also emit a source of light that is extremely hot and uncomfortable to work besides.

U.S. Pat. Nos. 1,684,374, 2,034,913 and 4,417,299 respectively show a flashlight, a hand lamp and a battery-powered light all attached to spring clamps. U.S. Pat. No. 2,966,580 shows two flashlights in a single handheld unit. In the cases noted above, none of these cited references set forth a portable, lightweight, battery-powered light which not only clamps onto a variety of objects, but which also consists of two independent sources of light integrally built into the clamp apparatus.

Accordingly, principle objectives of the present invention are to provide a portable, lightweight and easy to use clamp having two gripping jaws and a pair of longlasting, battery-operated flashlights integrally built into the jaws. In accomplishing those needs, the invention allows one to clamp and secure the apparatus in hard-to-reach places while aiming a dual source of light on a given work place and allowing the user to freely use both hands without the aid of an assistant.

SUMMARY OF THE INVENTION

The present invention provides a new and improved battery-operated clamp light which is portable, longlasting, lightweight, easy to attach to most objects and which includes a dual source of cool light.

The dual-lighted clamp illustrating the principles of the invention is provided with heavy duty clamp members, or jaws, and arrangements for providing a powerful force toward closing the jaws so that two parts may be firmly clamped together, while the areas on each side of the clamp jaws are fully illuminated. The jaws may be biased together by a heavy duty spring, or alternatively the jaws may be held together mechanically by arrangements such as are found in so called "Vice-Grip" tools. Therefore, the clamp is so formed that it acts by pressure and friction on the article on which it is to be clamped in order to effect a secure hold on a variety of articles of any shape.

The handles of the clamp each contain a housing for a flashlight assembly. The flashlight assemblies each include a cylindrical hollow tube which is molded in each handle. Within each tube a stainless steel slide unit is received. Attached at the front end of each slide unit is a plastic disk. Both disks include an electrical socket in which a mini-light bulb is connected. Each light bulb is received into its respective jaw by passing from its socket through an opening located along the back wall of the jaw. The light bulbs are protected and encased by separate transparent illuminating areas at the front of each of the jaws. This disk has an electrical contact means attached to one of the socket openings leading to a stainless steel spring located on the opposite side of the disk. Another electrical lead is attached to the remaining socket opening and the stainless steel slide unit. On the opposite end of the slide unit, a switch holding unit with a switch body is attached. Two size AA batteries are received in between the stainless steel spring and the switch holding unit to provide the necessary source of energy to illuminate the light bulb. The slide unit along with the molded cylindrical hollow tube provides the necessary casing for the batteries.

In accordance with a broad aspect of the invention, the dual-lighted clamp includes a pair of clamping jaws, and lights mounted on each jaw or on two sides of the clamp for illuminating two areas adjacent the respective jaws of the clamp.

Accordingly, it is an object of the present invention to provide a clamping apparatus having a dual source of light which may be properly aimed at a given work area. For example, a plumber may attach this clamp to a nearby pipe or an automobile mechanic may attach this clamp light to any portion of an automobile, thus enabling these tradesmen to work freely with both hands while directing illumination over a broad work area.

It is also another object of the present invention to enable one to clamp two or more parts together while providing the user with sources of illumination extending to both sides of the clamped parts.

Still another object of the invention is to clamp two hinged parts of an object together which are secured by bolt and glue.

Other objects, features and advantages of this invention will become apparent from a consideration of the following detailed description of the accompanying drawings.

DETAILED DESCRIPTION OF THE PREFERRED EMBODIMENT

Figures 1, 2, 3, 5:
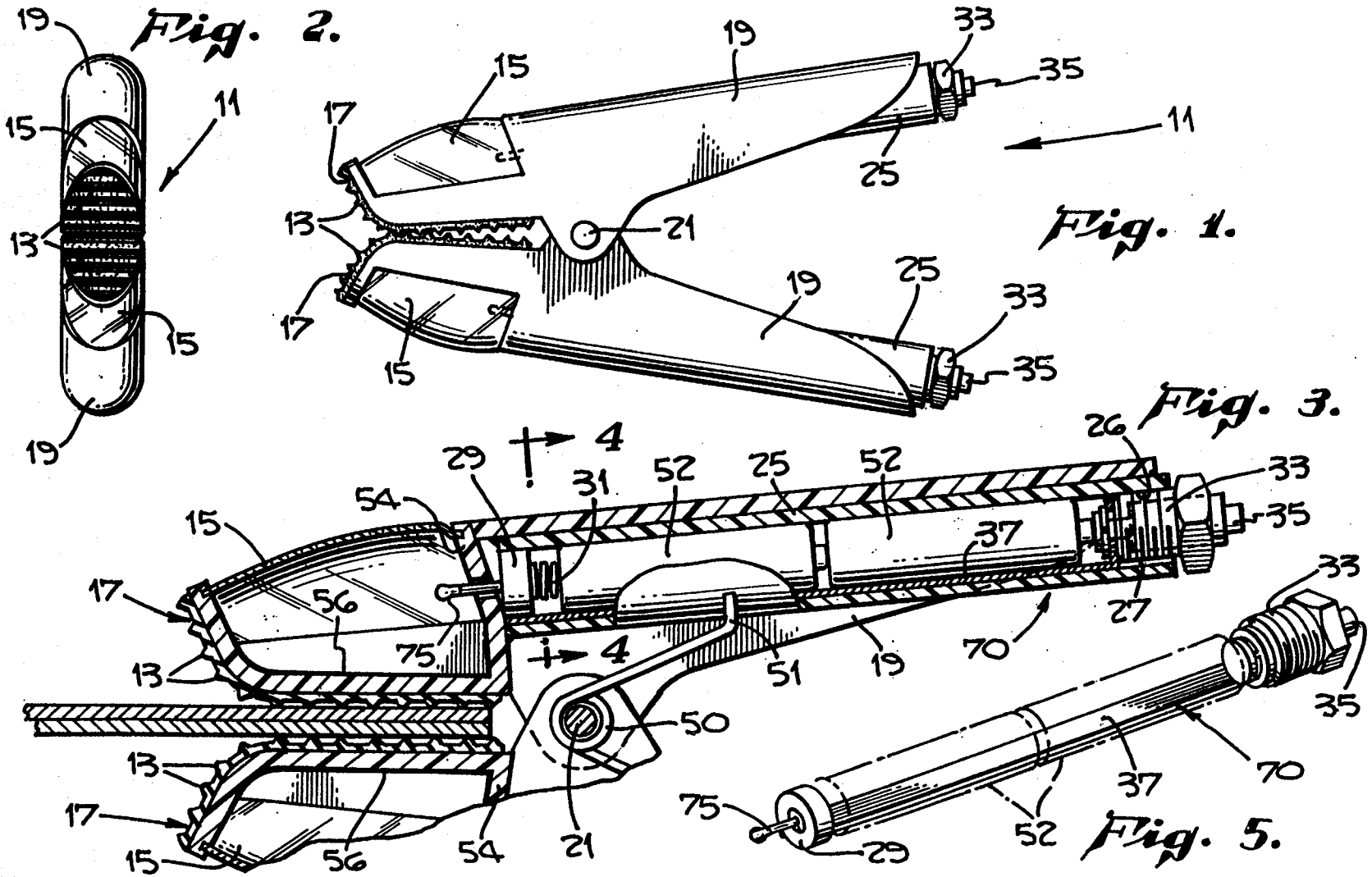
FIG. 1 is a side elevation view of the entire dual-lighted clamp apparatus.
FIG. 2 is a front elevation view of the dual-lighted clamp apparatus.
FIG. 3 is a partial cross-sectional view of the dual-lighted clamp apparatus illustrating the invention.
FIG. 5 is a perspective view of the portions of the dual-lighted clamp illustrating the flashlight assembly.

Referring more particularly to the drawings, FIG. 1 shows a dual-lighted clamp apparatus 11. The clamp apparatus 11 may be constructed high strength, yet lightweight, plastic or sheet metal. The clamp apparatus 11 may be covered throughout with a thin layer of non-conductive material such as rubber or plastic. The clamp apparatus 11 essentially consists of a pair of clamp jaws 17 which are pivotally mounted between their ends on a shaft 21 forming a common pivot axis allowing each jaw 17 to be positioned in an opposed clamping relationship with the other jaw 17.

Beyond the pivot axis and shaft 21, the clamp jaws 17 further extend to form a pair of handle members 19.

The clamp jaws 17 are biased toward the clamping position (as shown in FIG. 2) by means of a wire spring 50 (as shown in FIG. 3). This wire spring 50 is preferably made of spring steel which is put under tension and has several turns around the pivot shaft 21. The ends of the spring 51 are secured to the underside of each handle member 19.

By squeezing the handles 19 together the clamp jaws may be opened to envelop a number of articles. By releasing the pressure on the handles 19 the clamp jaws 17 will then firmly attach to the given article or hold secured parts together.

The jaws 17 are covered with teeth 13. The teeth 13 enhance the gripping action of the jaws 17. These teeth 13 are molded, preferably, from a non-conductive, durable and resilient material (i.e., plastic or rubber) and are affixed to the gripping surface of each jaw with a suitable adhesive. The teeth 13 permit the jaws 17 to accommodate to the shape of the object or objects to which the clamp 11 is attached. One reason for making the teeth 13 from a non-conductive material is to prevent the user from receiving any kind of electrical shock that may be received from certain articles to which the clamp 11 may be attached. Alternatively, the teeth 13 may be integrally molded into the jaws 17.

The dual-lighted clamp 11 also includes two flashlights assemblies 70 individually housed in each handle member 19.

Figure 4:
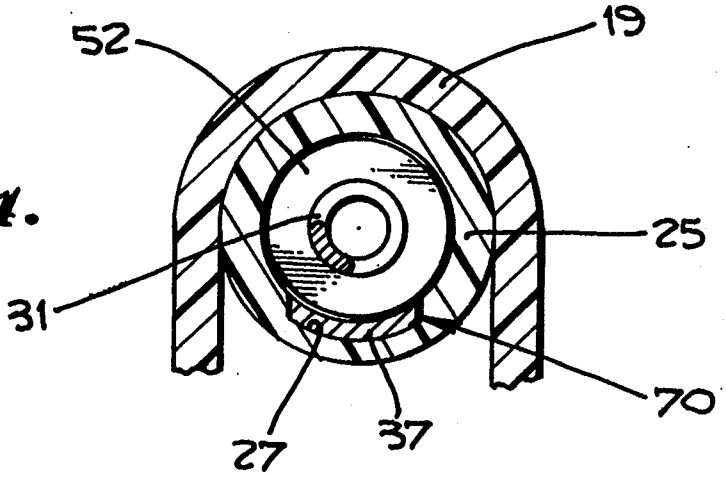
FIG. 4 is a sectional view taken along lines 4—4 of FIG. 3.

On the underside of each handle 19 lies a hollow cylindrical tube 25 molded to or otherwise secured to the handle 19. FIG. 3 best illustrates the design of these hollow tubes 25. The hollow tubes 25 extend adjacent to the back wall 54 of each jaw and protrude a slight distance beyond the ends of each handle 19. The end of the hollow tube 25 extending beyond the ends of the handles 25 is threaded 26. The circumference of each tube 25 should be large enough to rest flush against and conform to the inner surface of each handle 19. It is preferred that the tubes 25 be made of PVC or ABS plastic. The inner surface of each tube 25 includes a channel 27 as shown in FIG. 4. The width of each of the channels is, as shown in FIG. 4, preferably substantially less than the inner diameter of the tube 25.

Figure 6:
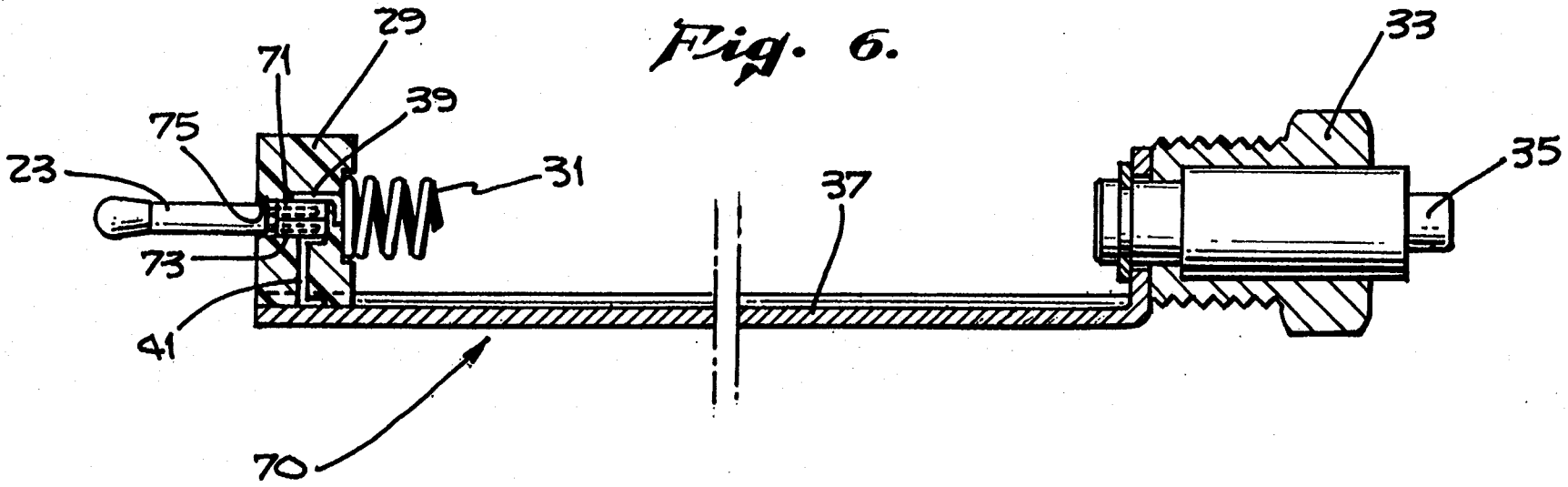
FIG. 6 is a side view of one of the slide unit assemblies of the dual-lighted clamp.

The channels 27 provide a track in order to receive a slide unit comprising the central assembly of the components of the flashlights 70. FIG. 6 illustrates the flashlight assembly 70. The central assembly 70 includes a slide unit 37 which is made of a non-corrosive conductive metal, preferably stainless steel. The width of each slide unit 37 must be sufficiently wide enough and the length sufficiently long enough to enable the slide units 37 to be fully and securely received along each channel 27 of the molded tubes 25.

Alternatively, each slide unit 37 may also be assembled integrally in each hollow tube 25. In this embodiment, the channels 27 may be omitted from the hollow tubes 25.

On the end of the slide unit 37 to be initially inserted into the tube 25, a disk 29 made of some non-conductive rigid material, preferably plastic, is attached. The disk 29 has a circumference slightly smaller than the molded hollow tube 25.

One side of the disk 29 includes a light bulb socket 75 having two electrical terminals 71, 73. A spring 31 made of a non-corrosive material is attached to the opposite side of disk 29. One light bulb 23 is inserted into each socket 75 (as shown in FIG. 3). The bulb 23 passes through an opening in the back wall of the jaw 17 into the jaw 17.

Both light bulbs 23 are individually covered by a separate transparent illuminating cap 15 situated at the front of each jaw 17 and are removable in order to clean the inside of caps 15.

In cases where the slide units 37 are integral with the hollow tubes, the light bulbs 23 are replaced by simply removing the transparent caps 15 and removing the bulb from its socket.

The entire inner surface of each jaw 17 which lies underneath each cap 15 may be made of or covered with a reflective material 56.

One of the terminals 71 of the socket is connected to an electrical lead 39 which is connected to the spring 31 to form one battery contact.

The other terminal 73 is connected to a second electrical lead 41 through the disk 29 which is attached to the slide unit 37 to form the remaining battery contact.

On the opposite end of the slide unit 37 a switch holding unit 33 with a switch body 35 is attached. Two cylindrical batteries are received between the spring 31 and the switch body 35 while resting on the top surface of the slide unit 37. The switch holding units 33 are threaded in order for them to be screwed into the threaded portion of the hollow tubes 26 to secure the entire flashlight assembly 70.

The switch body 35 is a push-button mechanism. When the central switch body actuator is pressed to turn on the light bulb 23 it completes the circuit through the batteries 52, thus energizing the light bulb 23. By subsequently pressing the actuator of switch 35, the circuit is disconnected and the light bulb is shut off.

The dual-lighted clamp 11 of the present invention is portable, lightweight, easy to use, and inexpensive to manufacture. It also provides a cool, low voltage source of light. The clamping jaws 17 of present invention may be attached to most objects and even in hard-to-reach places. The push-button switch mechanism 35 is also simple to use.

Although the clamp 11 may vary in size, in one practical embodiment, two size AA batteries 52 for each flashlight assembly 70 is preferred. The overall length of the present invention is approximately eight inches long and the jaws 17 may open up to a maximum distance of approximately three inches.

While the invention has been particularly shown and described in reference to the preferred embodiment, it will be understood by those skilled in the art that changes in form and detail may be made without departing from the scope of the invention. Thus, by way of example and not of limitation, the invention is applicable to other types of clamps, for examples, the large furniture clamps with two jaws and two long threaded handles for adjusting the jaw positions, and clamps of the "Vice-Grip" type; with lights (either AC or battery operated) in each case being attached to the two jaws of the clamp. Accordingly, the present invention is not limited precisely to the structure as shown in the drawings and described in the foregoing detailed description.

What is claimed is:

1. A dual-lighted clamp comprising:

a first clamp jaw with a first transparent illuminating cap;

a second clap jaw with a second transparent illuminating cap mounted for cooperation with said first clamp jaw to clamp objects between said jaws;

means for actuating said jaws to the clamping configuration;

a first light assembly mounted in said actuating means and extending into said first clamp jaw to direct illumination through said first transparent illuminating cap in an area adjacent to said first clamp jaw;

a second light assembly mounted in said actuating means and extending into said second clamp jaw to direct light through said second transparent illuminating cap in an area adjacent to said second clamp jaw; and switches for operating said first and second light assemblies independently of the operation of said actuating means and said jaws.

2. A dual-lighted clamp according to claim 1 wherein said first and second light assemblies are separately and integrally mounted in said means for actuating said jaws.

3. The dual-lighted clamp of claim 1 wherein said clamp is made of a rigid and durable lightweight metal or plastic material.

4. The dual-lighted clamp of claim 1 wherein said jaws include teeth for firmly gripping objects.

5. The dual-lighted clamp of claim 1 wherein said first and second transparent illuminating caps are removable.

6. The dual-lighted clamp of claim 5 wherein an entire inner surface of each jaw which lies underneath said first and second transparent illuminating caps is made of or covered with a reflective material for directing light from said light bulbs through said first and second transparent illuminating caps.

7. The dual-lighted clamp of claim 1 wherein said first and second assemblies each include an electrically conductive slide unit consisting of a light bulb socket with two terminals, a first electrical lead forming an electrical contact with one terminal and an electrically conductive spring, a second electrical lead forming an electrical contact with the other terminal and said electrically conductive slide unit, and a switch holding member having a switch actuator means.

8. The dual-lighted clamp of claim 7 further including a separate light bulb attached to each socket and passing through an opening located along a back wall of each jaw into each jaw.

9. A portable, lightweight, battery-operated, dual-lighted clamp apparatus comprising:

a pair of jaws pivotally mounted between their ends on a means forming a common pivot axis which allows each jaw to be diametrically opposed to each other in a clamping position;

a pair of handle members;

a pair of hollow cylindrical tubes each molded in said handle members and having an inner circumference slightly larger than an outer circumference of a size AA battery;

a pair of channels individually located on an inner surface of said hollow tubes, having a length approximately equal to a length of said hollow tube and a width substantially less than a diameter of said hollow tube;

a pair of removable stainless steel, 20 gauge slide units individually inserted along each said channel;

said slide units each including a plastic disk attached to one end of said slide unit;

said slide unit being substantially equal in length to said hollow cylindrical tube;

a light bulb socket with two terminals mounted on one face of said disk;

said light bulb sockets each having a first electrical lead forming an electrical contact with an electrically conductive spring, and a second electrical lead connected to said slide unit;

said conductive spring being attached on the face of said disk opposite to said socket;

a light bulb attached to each socket and passing through an opening into each jaw;

a threaded switch holding member consisting of a push-button switch means in which said light bulbs are energized by activating said push-button means;

said hollow tubes each having a threaded portion for receiving said switch holding member;

a pair of size AA batteries received between said electrically conductive spring and said push-button switch means;

a pair of transparent illuminating caps located at front of each jaw; and a wire spring in which a wire made of spring steel is put under tension having several turns around said common pivot axis.

10. The dual-light clamp of claim 3 wherein said clamp apparatus is made of a durable lightweight metal covered with a non-conductive rubber or plastic material.

11. The dual-lighted clamp of claim 3 wherein said transparent caps being easily removeable, insertable and replaceable.

12. The dual-lighted clamp of claim 3 wherein said hollow cylindrical tube is made of PVC or ABS plastic.

13. The dual-lighted clamp of claim 3 wherein an entire inner surface of each jaw which lies underneath said caps is made of or covered with a reflective material for directing light from said light bulbs through said transparent caps.

14. The dual-lighted clamp of claim 3 wherein said jaws are covered by teeth made of a non-conductive, resilient and durable plastic or rubber material.

15. A portable, lightweight, battery-operated, dual-lighted clamp comprising:

a pair of jaws pivotally mounted between their ends on a means forming a common pivot axis which allows the jaws to be diametrically opposed to each other;

a pair of handle members;

a separate flashlight assembly located in each handle member;

a separate light bulb passing through an opening into each jaw;

a separate transparent cap located at a front of each jaw;

a pair of PVC or ABS plastic cylindrical tubes each molded in said handle and threaded at one end for fully receiving said flashlight assembly;

a pair of channels individually located along an inner surface of said cylindrical tubes; and a wire spring in which a wire made of spring steel is put under tension having several turns around said common pivot axis.

16. The dual-lighted clamp of claim 15 wherein said clamp is made of a rigid and durable lightweight metal or plastic material.

17. The dual-lighted clamp of claim 15 wherein said handles and said jaws are covered with a non-conductive gripping material made of either a rubber or plastic material.

18. The dual-lighted clamp of claim 15 wherein said jaws include a gripping surface covered with a non-conductive, resilient and durable tooth-shaped plastic or rubber material.

19. The dual-lighted clamp of claim 15 wherein each flashlight assembly includes a slide unit made of an electrically conductive material, a plastic disk having a light bulb socket with two terminals, a first electrical lead forming an electrical contact with one terminal and an electrically conductive spring, a second electrical lead forming an electrical contact with the other terminal and said slide unit, and a threaded switch holding member having a switch actuator means.

20. The dual-lighted clamp of claim 15 wherein an entire inner surface of each jaw which lies underneath said caps is made of or covered with a reflective material for directing light from said light bulbs through said transparent caps.

* * * * *